United States Patent [19]

Ohashi et al.

[11] 4,181,711

[45] Jan. 1, 1980

[54] SEALING MATERIAL

[75] Inventors: Nozomu Ohashi; Okimasa Yamamuro; Takasuke Asakura; Akira Nakagawa, all of Ibaraki, Japan

[73] Assignee: Nitto Electric Industrial Co., Ltd., Ibaraki, Japan

[21] Appl. No.: 972,172

[22] Filed: Dec. 21, 1978

Related U.S. Application Data

[63] Continuation of Ser. No. 821,011, Aug. 1, 1977, abandoned.

[30] Foreign Application Priority Data

Jul. 30, 1976 [JP] Japan ..... 51-103017[U]
Jun. 10, 1977 [JP] Japan ..... 52-69062

[51] Int. Cl.[2] ..... B32B 33/00

[52] U.S. Cl. ..... 428/40; 428/85; 428/90; 428/95; 428/906

[58] Field of Search ..... 428/40, 85, 90, 95, 428/906

[56] References Cited

U.S. PATENT DOCUMENTS

| | | | |
|---|---|---|---|
| 1,960,137 | 5/1934 | Brown | 428/40 |
| 3,502,207 | 3/1970 | Alexander | 428/40 |

*Primary Examiner*—Marion E. McCamish
*Attorney, Agent, or Firm*—Sughrue, Rothwell, Mion, Zinn and Macpeak

[57] ABSTRACT

A sealing material comprising a sealing strip and a peeling tape overlying the sealing strip, with the peeling tape having substantially the same width as the sealing strip and having a low adhesiveness on both sides thereof, wherein one or both edges of the sealing strip are flocked with short fibers with or without a bonding layer.

8 Claims, 4 Drawing Figures

SEALING MATERIAL

This is a continuation of application Ser. No. 821,011, filed Aug. 1, 1977, now abandoned.

BACKGROUND OF THE INVENTION

1. Field of the Invention

The present invention relates to sealing materials for use in filling in a clearance or between a joint in a building or in construction (hereinafter a clearance portion) to render the clearance portion or joint portion waterproof.

2. Description of the Prior Art

Hitherto, in order to improve the waterproofness of a clearance portion or joint portion formed at the joining area where outer wall panels abut each other, a sealing strip molded from a sealing rubber composition has been inserted or placed therein.

With such a sealing material, however, a tape which in use is peeled off (hereinafter "peeling tape" for brevity) and which has a width of about 1.5 to about 3 times that of the sealing strip and has a low adhesiveness on both sides of the tape is overlaid on the sealing strip to form a sealing material. The sealing material is wound around a core in such a manner that a peeling tape is outside. Therefore, if the sealing strip wound in a roll form is wrapped with a wrapping paper, the surplus portion or brim projecting from the edge of the sealing strip is bent, and thus results in the formation of winkles. The thus formed winkles deform the side of the sealing strip wound in a roll form, deteriorating the dimension stability of the sealing strip. Thus, when the sealing strip is unwound and filled, inserted or placed in a clearance portion or joint portion, disadvantageously it is necessary to press the strip until the deformation is eliminated.

On the other hand, in filling the sealing strip unwound from the core in a joint portion by pressing, since the unwound sealing strip is positioned on the back side of the peeling tape, the area to be filled is shielded and cannot be seen, and thus a disadvantage occurs in that the sealing strip is or may be forced out of the joint portion. In particular, where the joint portion is not straight, the projection of the sealing strip inevitably occurs.

It is preferred for the sealing strip to have sufficient thickness to absorb vibration and/or the expansion and contraction of a building. However, since conventional sealing strips are colored black or grey due to limitations arising from production techniques, when those conventional sealing strips having sufficient thicknesses are used, a striking contrast is formed. Therefore, the inevitable disadvantage is the appearance of a building is deteriorated.

SUMMARY OF THE INVENTION

An object of the present invention is to provide a sealing material which is materially different from conventional sealing materials prepared by overlaying a peeling tape on a sealing strip molded from a sealing rubber composition to form a sealing material and winding the sealing material around a core; that is, to provide a sealing material prepared by overlaying on a sealing strip molded from a sealing rubber composition a peeling tape having substantially the same width as the sealing strip.

Another object of the present invention is to provide a sealing material which is compatable with the appearance of a building and has good weather resistance.

A further object of the present invention is to provide a sealing material in which deformation of the side of a sealing strip wound in a roll form is prevented and contacting of sealing strips at the sides thereof to shield a peeling tape is prevented.

The sealing material of the present invention can be easily filled, inserted or placed in a clearance portion or joint portion, provides a decorative effect, and can be easily unwound from the core.

The present invention provides a sealing material prepared by overlaying a peeling tape on a sealing strip molded from a sealing rubber composition in which the width of the peeling tape is substantially the same as that of the sealing strip and one or both sides of the sealing material are provided with short fibers with or without a bonding layer. The sealing material is wound around a core in such a manner that the peeling tape is outside. When the sealing material is wound around the core, since one or both edges of the wound product are provided with short fibers, the edges of the wound product are covered with the fibers, and thus it is materially impossible to contact the sealing strip and little or no adhesion is felt even though the edge of the rolled product is pressed with a finger.

DETAILED DESCRIPTION OF THE INVENTION

Figure 1:
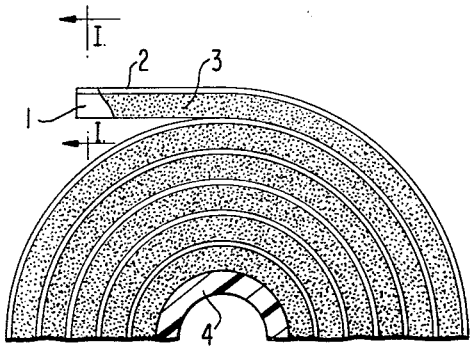
FIG. 1 is a partial side view of a sealing material of the present invention.

A sealing strip for use in a sealing material of the present invention is produced by molding or molding and cutting a sealing rubber composition prepared by adding the desired amount of the components as shown below to a major component comprising synthetic rubbers, e.g., having a Mooney viscosity ML 1+4 (100° C.) of 10 or more, such as butyl rubber, ethylene-propylene rubber, ethylene-propylene-diene rubber, styrene-butadiene rubber, chloroprene rubber and/or natural rubbers by means of an extruder, calender rolls, etc. Suitable synthetic rubbers are described in U.S. Pat. No. 3,018,208.

The components to be added to the major synthetic rubber component are as follows:

(1) Adhesion providing resins such as polyterpene based resins, cumarone-indene based resins and the like, preferably having an average molecular weight of about 300 to about 3,000, a specific gravity of about 0.96 to about 1.1 and a melting point of about 60° to about 125° C.

(2) Softening agents such as a lubricating oil, e.g., spindle oil, machine oil, cylinder oil, process oil, e.g., a paraffin based process oil, an aromatic process oil, a petroleum asphalt process oil, liquid polyisobutylene, polybutene, preferably having an average molecular weight of about 200 to about 2500 and a specific gravity of about 0.85 to about 0.95.

(3) Rubber reinforcing agents such as carbon black, e.g., channel black, furnace black, thermal black, acetylene black, silicas, e.g., silicic anhydride, silicic acid hydrates, synthetic silicates, colloidal silica, preferably having a particle size of about 10 to about 100 mμ and a specific gravity of about 1.0 to about 2.2.

(4) Fillers such as calcium carbonate, clay, preferably having a particle size of about 0.5 to about 50μ and a specific gravity of about 2.5 to about 2.8.

(5) Other well known plasticizers, antioxidants, pigments, synthetic resins and the like.

The sealing rubber composition used in molding the sealing strip of the present invention can be prepared by adding about 5 to about 100 parts by weight, preferably 20 to 40 parts by weight, of an adhesion providing resin, about 20 to about 200 parts by weight, preferably 50 to 150 parts by weight, of a softening agent, about 5 to about 30 parts by weight, preferably 10 to 20 parts by weight, of a rubber reinforcing agent, about 50 to about 300 parts by weight, preferably 100 to 200 parts by weight, of a filler, and if desired, about 20 to about 100 parts by weight of other additives to 100 parts by weight of the above major synthetic rubber component, and then the Mooney viscosity of the sealing rubber composition is adjusted to ML 1+4 (100° C.) 7 to 50.

The thus prepared sealing rubber composition is molded into a sealing strip of a thickness of about 1 to about 30 mm, a length of about 1 to about 100 m and a width of about 5 to about 100 cm by means of, for example, a rubber extruder. On one side of the sealing strip so produced is overlaid a peeling tape having the same width as the sealing strip with the peeling tape having a low adhesiveness on the both sides. The sealing material is then wound around a core in such a manner that the peeling tape is outside, whereby a product in a roll form is obtained.

In accordance with another method of producing a roll-like product, the sealing rubber composition is molded into a wide sheet of a thickness of about 1 to about 30 mm and a width of about 300 to about 1000 mm by means of a calender roll, and a wide peeling sheet is overlaid the wide sheet prepared above. The resulting member is then wound around a core to produce a raw material roll, which is then cut into the desired widths and thus the objective product is obtained.

The above peeling tape or sheet having a low adhesiveness can be a resin-coated paper as is usually employed. Such a resin-coated paper can be produced by laminating a synthetic thermoplastic resin such as a polyethylene resin on both sides of a paper support such as kraft paper, coating a low adhesivity synthetic resin such as a silicone resin, a fluorine resin on the above laminated surface, and drying. In addition, those resin coated papers prepared by coating the above described low adhesivity synthetic resin on a paper support having good lubricity and less permeability such as glassine paper, parchment paper, and drying, and a peeling synthetic resin film prepared by coating the above described low adhesivity synthetic resin on a synthetic resin film having good heat resistance, such as a polyethylene terephthalate film and drying can be used.

On the sealing strip produced by molding the sealing rubber composition is overlaid a peeling tape having the same width as the sealing strip and having a low adhesiveness on the both sides, and the resulting member is wound around a roll in such a manner that the peeling tape is outside. On one or both edges of the sealing strip wound in the roll form as described above are flocked tightly short fibers with or without a bonding layer whereby the sealing material of the present invention is obtained.

The short fibers are flocked on the edges of the sealing strip at a right angle to or at a certain angle to the surface by the electric flocking method.

Examples of short fibers which can be used include synthetic fibers such as those of polyamides (e.g., nylon), polyesters regenerated cellulose (e.g., rayon), polypropylene, etc. and natural fibers such as cotton, hemp, etc. having a thickness of about 0.5 to about 20, denier, preferably 1 to 10 denier, and a length of about 0.1 to about 3 mm, preferably 0.5 to 2 mm, and colored as desired.

The amount of the short fiber to be added is about 300 to about 1000, preferably 500 to 800, short fibers per square centimeter of the surface. With below about 300 short fibers per square centimeter, the base color of the sealing strip can be seen and the effect of the sealing material of the present invention as hereinafter described cannot be obtained. On the other hand, use of more than about 1000 short fibers per square centimeter is disadvantageous in that it is not economical and in that the deformation capability of the edge of the sealing strip is prevented; for example, it is particularly difficult to insert the strip under pressure.

In a preferred electric flocking method which can be used in producing the sealing material of the present invention, short fibers are placed in a wire net, the distance between the electrodes is controlled at about 2 to about 100 mm, preferably 4 to 20 mm, the roll-like product is disposed so that it is at a right angle or a certain angle to the surface of the electrode; that is, to the flying direction of the short fibers, and an electrostatic voltage of about 10 to about 60 KV is applied between the electrodes. For improving the adhesion of the short fibers flocked and preventing the short fibers flocked from easily coming off due to external friction, it is preferred for the flocking to be carried out by applying an electrostatic voltage of at least about 10 KV per from about 4 to about 50 mm of the distance between the electrodes.

However, depending upon the kind of sealing rubber composition, the flocking can be carried out by controlling the distance between the electrodes or the electrostatic voltage. Some of the sealing rubber compositions do not have a viscosity which is appropriate to enable the short fibers on flocking to become sufficiently embedded to resist external friction. In this case, it is desirable for the edges of the sealing strip on which the short fibers are to be flocked to be heated at about 100° C. for about 0.5 to about 5 minutes using a heat source such as an infrared ray heater to thereby soften the edges to such a viscosity that flocking can be accomplished, and then the flocking is carried out to thereby effectively prevent the short fibers from coming off due to friction.

Alternatively, the flocking can be carried out without heating as described above by providing a bonding layer on the edge of the sealing strip. The bonding layer can be produced by coating a binder, in which the short fibers can be flocked easily, such as a solvent-type pressure-sensitive adhesive (e.g., prepared by mixing a natural rubber and a rosin ester and dissolving the mixture in an organic solvent such as toluene or hexane, with a solid content of about 20 to about 40 wt%), an emulsion-type pressure-sensitive adhesive (e.g., prepared by mixing an alkyl acrylate and acrylic acid and dispersing the mixture in the presence of an emulsifying agent, water and a crosslinking agent, with a solid content of about 20 to about 50 wt%), a heat-curable adhesive (e.g., comprising an epoxy resin component (Bisphenol A and epichlorohydrin) and a curing component (a primary amine, a secondary amine, etc.), in which the two components are mixed on use), or a solvent evaporation-curable adhesive (e.g., prepared by mixing a vulcanizing agent, a filler, an anti-ageing agent, an adhesion providing resin, etc. with a polychloroprene raw rubber, and dissolving the mixture in an organic solvent such as toluene, methyl ethyl ketone, ethyl acetate, etc.), and the short fibers are flocked in the bonding layer. Where the bonding layer is formed by coating, for example, a well known emulsion type pressure-sensitive adhesive, the pressure-sensitive adhesive can be coated in an amount of about 20 to about 150 g/m$^2$ and dried at about 80° C. for about 1 to about 10 minutes.

Figure 2:
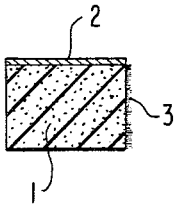
FIG. 2 is a sectional view of the sealing material of FIG. 1 which is cut away along the line I-I' and viewed in the direction indicated by the arrow.

The sealing material of the present invention has a structure as shown in FIG. 1 and FIG. 2. In FIG. 1, 1 is a sealing strip produced by molding a sealing rubber composition, and 2 is a peeling tape having substantially the same width as the sealing strip and having a low adhesiveness on both sides. 3 indicates short fibers which are flocked directly on one edge of the sealing strip of the roll-like product prepared by winding a sealing material comprising a sealing strip and a peeling tape overlaid on the sealing strip around a core 4 such as a synthetic resin tube, a paper tube, or the like.

Figure 3:
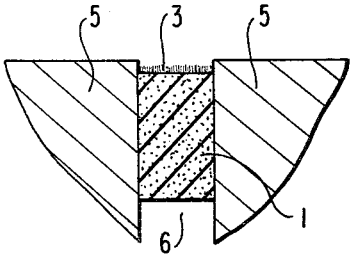
FIG. 3 is a partial sectional view of a sealing material which is used in filling a clearance portion.

FIG. 3 is a sectional view of a sealing material of the present invention which is practically used in place. The peeling tape is removed from the sealing strip 1, and the sealing strip is inserted into a joint portion 6 between outer wall panels 5 and 5 in such a manner that the short fibers 3 flocked are exposed outside.

Figure 4:
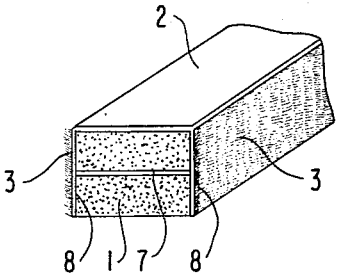
FIG. 4 is a partial perspective view of another sealing material of the present invention.

FIG. 4 is another strip unwound from the core used in the present invention. A reinforcing material 7 such as a synthetic resin film, e.g., a polyethylene film, a polypropylene film, a non-woven fabric, e.g., a polyamide (e.g., nylon) non-woven fabric, a polyester non-woven fabric, a regenerated cellulose (e.g., rayon) fabric, Japanese paper, cloth, etc., is inserted between the layers of the sealing strip 1 and the short fibers 3 are flocked on both edges of the sealing strip 1 and then the peeling tape 2 is overlaid on the sealing strip 1 to produce the sealing material of this invention. The material 7 prevents the sealing strip 1 from stretching and at the same time, prevents a fluid deformation of the strip after the laying operation and maintains waterproofness over a long period of time.

In the sealing material of the present invention, the peeling tape has the same width as the sealing strip and the short fibers are flocked with or without a bonding layer onto one or both edges of the sealing strip wound in a roll form.

With the thus-constructed sealing material of the present invention, the above described effect of preventing a fluid deformation of the strip by the flocking of the short fibers and the short fibers flocked themselves prevent the edges of the sealing strips from contacting each other during transportation and storage.

In addition, since the sealing strip is not obscured by the peeling tape at the time of inserting or placing in a clearance portion or joint portion, no area where the sealing strip is forced out or adhesion is insufficient is formed, and even if such areas are formed, they can be easily repaired.

Where the sealing material of the present invention is filled or placed in a clearance portion or joint portion which can be seen, a contrast in color can be prevented by using short fibers having the same color as the clearance portion or joint portion. Moreover, a decorative effect can be obtained by selecting short fibers of a different color, but in harmony with the color of the materials adjacent the clearance portion or joint portion. Therefore, the sealing material of the present invention can be used without deteriorating the appearance of a building. Furthermore, thick sealing materials can be used and the structure of the materials adjacent the clearance portion or joint portion does not need to be complicated so as to cover the sealing strip.

The short fibers flocked protect the sealing material from direct irradiation of sunlight, and therefore ageing or deterioration of the sealing strip can be effectively prevented and the life of the sealing strip can be lengthened.

The sealing material of the present invention will be explained by reference to the following examples, but the present invention should not be construed as being limited thereto, since, various modifications and variations may be made without departing from the scope and spirit of the present invention.

Unless otherwise indicated herein, all parts, percents, ratios and the like are by weight.

EXAMPLE 1

A mixture of 100 parts by weight of an ethylene-propylenediene terpolymer rubber (produced by Mitsui Petrochemical Co., Ltd., trade name: EDT#4045, Mooney viscosity ML 1+4 (100° C.) 40) and 10 parts by weight of carbon black (average particle size: 56 to 80 mμ, specific gravity: 1.8) was subjected to a first mixing in a mixer at a temperature of 80° to 90° C. for 5 minutes. Thereafter, 200 parts by weight of calcium carbonate (average particle size: 3.1μ, specific gravity: 2.7), 20 parts by weight of a cumarone-indene resin (average molecular weight: 620; melting point; 85° C.; specific gravity: 1.088) and 100 parts by weight of polybutene (average molecular weight: 1260; viscosity; 32000 cst at 37.8° C.) were added to the above mixture. The resulting mixture was subjected to a second mixing at a temperature of 80° to 90° C. for 10 minutes, and thus a sealing rubber composition having a Mooney viscosity ML 1+4 (100° C.) 18 was obtained.

The sealing rubber composition was introduced into a hopper of a rubber extruder provided with a die having an opening of 2 mm+15 mm, and a sealing strip having a cross section of the same form as that of the die was continuously obtained by driving the shaft.

On one side of a 15 mm wide sealing strip continuously extruded was overlaid a 15 mm wide peeling tape produced from a resin coated paper.

The thus prepared member was guided onto a paper tube of a width of 15.3 mm (outer diameter 75 mm) fixed on a rotary shaft, wound around the tube in such a manner that the peeling tape was outside, and cut in the desired length whereby a roll-like product was obtained.

Thereafter, one side of the roll-like product was flocked with short nylon fibers by means of a DC high voltage generator (produced by Nichicon Capacitor Ltd.) under the conditions of an electrostatic voltage of 20 KV and a distance between electrodes of 40 mm. The short nylon fibers had a thickness of 3 denier and a length of 1 mm and 600 to 700 of the fibers were flocked per square centimeter.

The portion of the short fiber embedded was on the average about 8 to 15% of the length of the fiber.

Ten rolls of the sealing materials of the present invention were stacked with the flocked surfaces thereof downward and the stack was allowed to stand at 80° C.×65% RH for 24 hours for heating testing. No adhesion between the rolls of the sealing materials occurred and they could be easily separated.

EXAMPLE 2

The procedures described in Example 1 were repeated, and at the time of the second mixing in producing the sealing rubber composition as described in Example 1, 50 parts by weight of silicic anhydride (average particle size 25 to 40 microns, specific gravity 2.1) was further added to form a sealing rubber composition having a Mooney viscosity ML 1+4 (100° C.) 30.

The thus obtained sealing rubber composition was continuously extruded in the form of a sheet by using a rubber extruder (opening of die: 2 mm×500 mm), and on one side of the sheet so obtained was overlaid a 500 mm wide peeling sheet comprising a resin coated paper. The resulting member was guided onto the center of a 600 mm wide cardboard tube, would around the tube in such a manner that the peeling sheet was outside, and thus a wide roll-like product was obtained.

This wide roll-like product was cut to roll-like articles having a width of 20 mm.

One side of the roll-like product was preheated at 100° C. for 1 minute using an infrared ray heater and flocked in the same manner as described in Example 1. The other side was preheated and flocked in the same manner as described above.

In this example, the short fibers had a thickness of 3 denier and a length of 1.5 mm (green nylon fiber) were used and 700 to 800 fibers were flocked per square centimeter. The portion of the fiber embedded was on the average 5 to 20% of the length of the fiber, and a sufficient decorative effect could be obtained.

EXAMPLE 3

On the side of a roll-like product produced as described in Example 2 was sprayed an emulsion type acrylic pressure-sensitive adhesive (prepared by mixing 50 g of butyl acrylate and 2.5 g of acrylic acid, and further adding thereto 1.5 g of an emulsifying agent (polyoxyethylene alkyl phenol ether), 200 ml of water and 2 parts of hexamethylenediisocyanate) in a proportion of 50 g per square meter, and the thus-sprayed adhesive was predried at 80° C. for 2 minutes to form a bonding layer. The thus obtained bonding layer was flocked in the same manner as described in Example 1, and the excess of short fibers was removed with an air gun.

The short fibers used in this example were rayon short fibers having a thickness of 3 denier and a length of 1 mm. 600 to 700 fibers were flocked per square centimeter. With the thus-obtained sealing material, the strength of the short fibers embedded was great and since the side of the sealing strip was covered with an acrylic based bonding layer having good weather resistance, the life of the sealing strip was long.

EXAMPLE 4

Both sides of a roll-like product produced as described in Example 2 were preheated at 100° C. for 1 minute using an infrared ray heater. On both sides thereof were flocked polyester fibers of a thickness of 15 denier and a length of 1 mm using a DC high voltage generator under the conditions of an electrostatic voltage of 30 KV and a distance between electrodes of 40 mm, wherein 400 to 500 fibers were flocked per square centimeter and at an angle of about 30° to the surface of the sealing strip.

Since the short fibers were flocked obliquely onto the side of the sealing material, the degree of shielding was high regardless of the flocking of a small number of fibers, and thus the deterioration of the sealing strip could be prevented for a long period of time.

While the invention has been described in detail and with reference to specific embodiments thereof, it will be apparent to one skilled in the art that various changes and modifications can be made therein without departing from the spirit and scope thereof.

What is claimed is:

1. A sealing material in a roll form comprising a sealing strip which is prepared by molding a sealing rubber composition having a Mooney viscosity ML 1+4 (100° C.) of about 7 to 50 comprising synthetic rubbers as the major component, and a peeling tape overlying one surface of the sealing strip, the peeling tape having substantially the same width as the sealing strip and being provided with low adhesiveness on both sides thereof, wherein one or both edges of the sealing strip are flocked with short fibers with or without a bonding layer, whereby deformation of the edge of the sealing strip wound in a roll form is prevented and contact of the sealing strip at the sides thereof is prevented.

2. The sealing material according to claim 1, wherein the synthetic rubber is selected from the group consisting of butyl rubber, ethylene-propylene rubber, ethylene-propylene-diene rubber, styrene-butadiene rubber and chloroprene rubber.

3. The sealing material according to claim 1, wherein the rubber composition contains an adhesion providing resin, a softening agent, a rubber reinforcing agent and a filler.

4. The sealing material according to claim 1, wherein the peeling tape is a resin-coated paper.

5. The sealing material according to claim 1, wherein the short fibers have a thickness of about 0.5 to about 20 denier and a length of about 0.1 to about 3 mm.

6. The sealing material according to claim 1, wherein the short fibers are selected from the group consisting of fibers of a polyamide, a polyester, polypropylene, regenerated cellulose, hemp and cotton.

7. The sealing material according to claim 1, wherein the bonding layer comprises a layer of a binder.

8. The sealing material according to claim 7, wherein the binder is an emulsion type pressure-sensitive adhesive.

* * * * *